US012691490B2

(12) United States Patent
MacCagnan

(10) Patent No.: US 12,691,490 B2
(45) Date of Patent: Jul. 28, 2026

(54) METHOD FOR THE PRODUCTION OF AN OBJECT

(71) Applicant: GIMAC INTERNATIONAL S.R.L., Castronno (IT)

(72) Inventor: Simone MacCagnan, Castronno (IT)

(73) Assignee: GIMAC INTERNATIONAL S.R.L., Castronno (IT)

( * ) Notice: Subject to any disclaimer, the term of this patent is extended or adjusted under 35 U.S.C. 154(b) by 0 days.

(21) Appl. No.: 18/875,440

(22) PCT Filed: Jun. 22, 2022

(86) PCT No.: PCT/IT2022/000029

§ 371 (c)(1),
(2) Date: Dec. 16, 2024

(87) PCT Pub. No.: WO2023/248261

PCT Pub. Date: Dec. 28, 2023

(65) Prior Publication Data

US 2025/0214130 A1 Jul. 3, 2025

(51) Int. Cl.
*B21D 47/00* (2006.01)

(52) U.S. Cl.
CPC ..... *B21D 47/005* (2013.01); *Y10T 29/49879* (2015.01); *Y10T 29/49892* (2015.01); *Y10T 29/49936* (2015.01)

(58) Field of Classification Search
CPC ..... Y10T 29/49879; Y10T 29/49892; Y10T 29/49936; B21D 47/005
See application file for complete search history.

(56) References Cited

U.S. PATENT DOCUMENTS 2,056,563 A * 10/1936 Eksergian ..... E04C 3/07 52/840
2,241,952 A * 5/1941 Lachman ..... E04C 2/423 428/116
2,814,718 A * 11/1957 Hardesty ..... B23K 11/0093 219/92
2,828,235 A * 3/1958 Holland ..... B32B 27/00 493/379
2,900,713 A * 8/1959 Young ..... B64C 3/00 29/455.1

(Continued)

FOREIGN PATENT DOCUMENTS

CN 110424623 11/2019

OTHER PUBLICATIONS

International Search Report and Written Opinion for PCT/IT2022/000029 mailed Feb. 17, 2023.

*Primary Examiner* — Jermie E Cozart
(74) *Attorney, Agent, or Firm* — Perilla Knox & Hildebrandt LLP; Jason M. Perilla

(57) ABSTRACT

A method for the production of an object comprises the steps of providing a base element, providing a plurality of section bars, and fastening the section bars to one surface of the base element. The method further comprises the steps of defining a plurality of restraint elements, which are active along a vertical axis with respect to the base element, by means of one or more of the section bars, and applying a filling material onto the base element at least in one engagement portion cooperatively defined between the surface and at least one of the restraint elements.

10 Claims, 6 Drawing Sheets

(56) References Cited

U.S. PATENT DOCUMENTS

| | | | | | |
|---|---|---|---|---|---|
| 2,905,064 | A | * | 9/1959 | Nielsen | B23Q 3/086<br>62/DIG. 10 |
| 2,960,197 | A | * | 11/1960 | Langhans | B21D 47/00<br>428/116 |
| 2,967,337 | A | * | 1/1961 | Hedrick | E06B 7/082<br>29/897.15 |
| 3,016,578 | A | * | 1/1962 | Rohe | F16B 5/01<br>428/116 |
| 3,033,086 | A | * | 5/1962 | Marsden | E04C 2/426<br>52/666 |
| 3,180,774 | A | * | 4/1965 | Koch | H02B 15/00<br>156/298 |
| 3,368,314 | A | | 2/1968 | Maynard | |
| 4,031,279 | A | | 6/1977 | Cremer et al. | |

* cited by examiner

METHOD FOR THE PRODUCTION OF AN OBJECT

TECHNICAL FIELD

The present invention relates to a method for the production of a semi-finished object.

In other words, the present invention concerns the technical field of production processes aimed at creating a support base in the form of a semi-finished product which, in the language used for this invention, can be defined as "a standard": such objects can be used for the construction of complex objects, such as for example structural elements and frames, both in the construction and industrial fields (and in several sub-sectors of the latter).

STATE OF THE ART

In the state of the art, it is well known to use a support base with its thickness and which can have various shapes. A filling material is then deposited which, following removal operations to adjust its shape and size, allows the final object to be obtained.

In particular, a filling material is deposited on this base by means of an additive manufacturing (or overmoulding or sintering) process.

Disadvantageously, the state of the art has shown that the filling material does not adhere properly to the base, and the use of honeycomb panels, i.e., panels equipped with a pair of plates and a honeycomb structure interposed between the plates, is known to overcome this drawback.

Honeycomb panels can be used in a wide variety of sectors due to their peculiar design, which makes them lightweight, therefore easy to use and install, and at the same time very resistant (directionally) to shocks, cracks and loads.

These panels can be used for the construction of complex objects, such as for example structural elements and frames, both in the construction and industrial fields, since they are both light and resistant thanks to the honeycomb structure.

In particular, one of the plates is milled and the filling material is fed between the honeycomb structure via the access hole obtained by milling.

In this way, the material deposited between the cavities settles under the upper plate and can no longer get out. Disadvantageously, the honeycomb structure—which can be produced by way of example in plastic material—is anchored to the plates (generally made of metal) by gluing.

By gluing the honeycomb structure to the surface, the anchoring would totally depend on the shear or tear properties of the adhesive and would last within a narrow thermal range, outside which, even for short periods, there would be a permanent loss of properties due to the misalignment of components or impairment of adhesive properties.

If, on the other hand, the honeycomb structure was to be welded to the surface, the inner part of the sandwich would be thermally stressed, thereby compromising the interface between the cavity and the plates containing it in a way that cannot be verified or quantified from a "predictive" perspective.

Instead, by opting for a mechanical constraint (e.g., bolting the honeycomb structure to the surface), there would be a risk of cutting—or more generally disrupting the structural continuity of—functional components which perform "crucial" load-bearing/structural functions within the panel.

Therefore, due to the above-mentioned joining methods, the performance and choice of materials to be deposited are limited since the connection between the components of such an object could degrade and cause the entire structure to collapse.

OBJECT OF THE INVENTION

Therefore, the technical task of this invention is to provide a method for the production of objects, which can overcome the drawbacks of the prior art.

The object of the present invention is therefore to provide a method for the production of objects, which allows production costs to be reduced and a wider range of materials to be used, thus preventing the "slippage" of the filling material from the base.

The specified technical task and objects are substantially achieved by means of a method for the production of objects, which comprises the technical features set forth in one or more of the accompanying claims.

The dependent claims correspond to possible embodiments of the invention.

According to the present invention, a method for the production of objects is shown, in particular a method for the production of a semi-finished object.

The method is carried out by providing at least one base element (preferably a laminar element) and at least a plurality of section bars.

The method further comprises fastening the section bars to one surface of the base element and defining a plurality of restraint elements along a vertical axis perpendicular to the laminar element by means of one or more of the section bars.

Lastly, the method comprises applying, preferably by means of an additive manufacturing process, a filling material onto the laminar element bearing the restraint elements.

According to one aspect of the present invention, the filling material is applied at least in one engagement portion cooperatively defined between the surface and at least one of the restraint elements.

Preferably, the base element is made of metal.

Preferably, the base element has a laminar or curved shape.

Preferably, the section bars are made of metal.

Preferably, the base element defines a smooth base.

Preferably, the section bars are arranged on the base element in such a way as to define a grid which is then welded to the base element.

Preferably, the section bars define a series of skewed, riveted or shaped welded metal strips so as to create an undercut to define the aforementioned restraint elements.

Preferably, the section bars define a series of metal strips fitted in a groove cut in the base element.

Preferably, the section bars are defined by a preformed foam welded to or made on the base element.

Preferably, the step of fastening the section bars to the base element is carried out by welding or sintering the section bars.

Preferably, the base element is cut out so as to form a plurality of grooves in said base element, and the fastening step is carried out by fitting the section bars into respective grooves.

Advantageously, the base element has a morphological and structural function.

Advantageously, the method is cost-effective compared to existing production methods of the prior art.

Advantageously, the restraint elements prevent the filling material from detaching from the laminar element.

Advantageously, the particular structure made of the base element, the section bars and the restraint elements, as well as the materials of which the different components are made, make it possible to work with different filling materials and thus at different temperatures from those which can be used in the state of the art.

According to a further aspect of the present invention, there is provided a semi-finished object which is made or can be made by means of the above production method.

Further features and advantages of the present invention will become more apparent from the indicative, and therefore non-limiting description of an embodiment of a method for the production of a semi-finished object.

BRIEF DESCRIPTION OF THE DRAWINGS

This description will be set forth hereinafter with reference to the accompanying drawings, which are provided for illustration purposes only, therefore not for limiting purposes, wherein.

DETAILED DESCRIPTION OF EMBODIMENTS OF THE INVENTION

The present invention relates to a method for the production of a semi-finished object 1 (in other words, the present method aims at providing a semi-finished or finished product); this method is carried out by providing a base element 2 which in turn comprises a surface 2*a* (e.g., positioned so as to be the "upper" surface in the attached figures, but which, depending on the needs of the moment, can be any surface oriented in any way).

The base element 2 can be made into the shape of a flat or curved laminar element, but more generally the base element 2 can have any shape suitable for obtaining the final semi-finished object 1.

The base element 2, for example, can be made of metal or other material, so this method can conveniently comprise a first step wherein a metal base is provided.

The base element 2 has a smooth surface 2*a* (or in any case having a predetermined surface roughness, also by means of appropriate surface machining using the present method), which is suitable for receiving the remaining structural components provided by the invention as engaged with a necessary degree of development of restraint reactions: to this end, the method also comprises providing a plurality of section bars 3.

A section bar 3 should be understood as a wall with a constant or variable cross-section, or as a straight or curved (e.g., sinusoidal) element: according to a further embodiment of the invention, a section bar 3 can also be understood as a foam (e.g., a so-called "metal foam").

Figure 1:
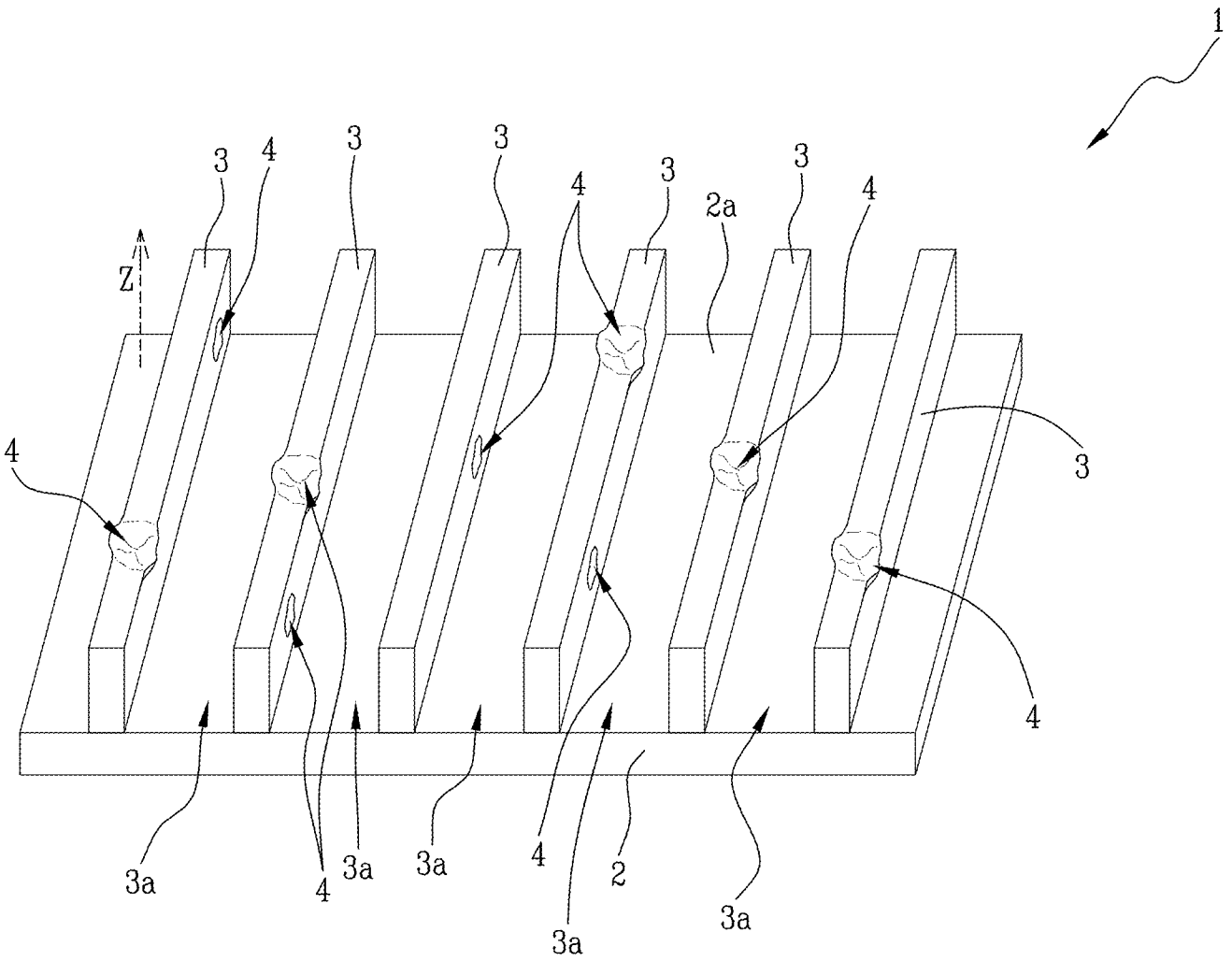
FIG. 1 is a schematic representation of a semi-finished object obtained by the method object of the present invention.
Figure 2A:
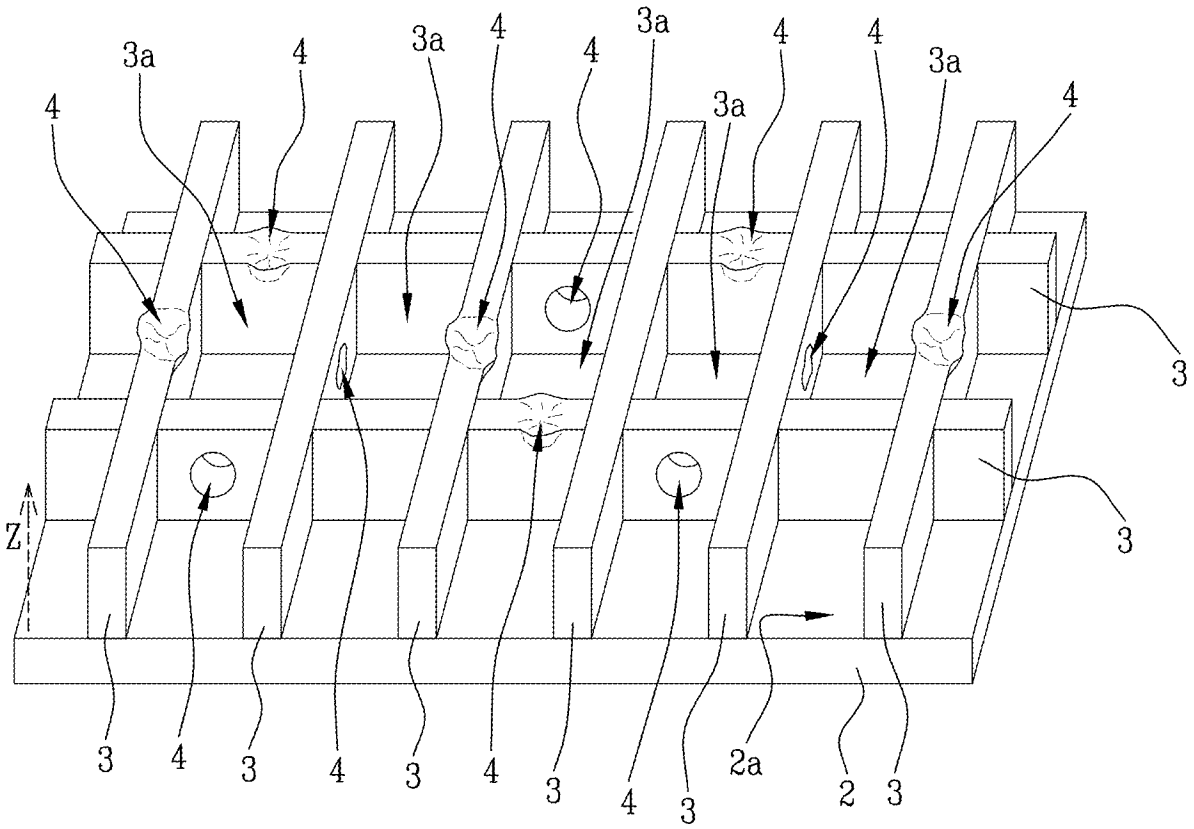
FIG. 2A is a schematic representation of an alternative embodiment of the object.

Generally, a section bar 3 in accordance with the invention is any element having a certain shape or length suitable for making the object 1. In accordance with the invention, the section bars 3 may be arranged so as to define a grid element in which said section bars 3 are "intertwined" (or crossed with each other to form a matrix pattern), as shown, for example, in the embodiment in FIGS. 2A and 2B.

The section bars 3 may be arranged so as to define a honeycomb structure having, according to the needs of the moment, any topology and/or spatial geometry: by way of non-limiting example, the honeycomb structure can have a plurality of spheroidal, i.e., spherical, semi-spherical, or essentially spherical cavities.

In other words, section bars 3 of different shapes can be connected together or side-by-side to define a specific shape.

Operatively, the step of providing the section bars 3 defines a plurality of containment cells 3*a:* therefore, the term "containment cell" 3*a* is understood as a portion of "empty" space defined between the various section bars 3, and each containment cell 3*a* may therefore have a parallelepiped or cylinder shape or other shape defined by the arrangement of the section bars 3.

The method further comprises a step of fastening the section bars 3 to the upper surface 2*a* of the laminar element 2: this fastening step therefore defines, with the base element 2, a bottom portion of each containment cell 3*a*.

The method also comprises a step of fastening the section bars 3 to the base element 2 by means of interlocking, welding or sintering, for example, this step of fastening the section bars 3 to the base element 2 is carried out by welding the section bars 3 to the upper surface 2*a* of the laminar element 2 (in other words, the steps of the method so far described make it possible to obtain a grid welded to a smooth base).

In one embodiment of this method, a step of cutting out the base element 2 may be provided in order to create a plurality of grooves on its surface 2*a:* in this way, the step of fastening the section bars 3 to the laminar element 2 is carried out by fitting the section bars 3 into respective grooves defined on its upper surface 2*a* (and therefore, in this embodiment, an object 1 is made, which is defined by a series of metal strips fitted in the grooves cut out in the base element 2).

Following the cutting out and fitting step, in accordance with the present method, a step can be provided for welding the section bars 3 to the base element 2: if the section bars 3 are defined by a foam, the latter may be pre-formed and welded or made directly onto the base element 2.

The method further comprises defining a plurality of restraint elements 4 along a vertical axis "Z" transverse, and for example perpendicular, to the base element 2, by means of one or more of the section bars 3: in this way, the restraint elements 4 are therefore active at least along the vertical axis "Z", and in other words, the method comprises providing restraint elements 4 which have the function of retaining the filling material 6, as will be clearer hereinbelow.

To this end, the method comprises creating an engagement portion cooperatively defined between the surface 2*a* and at least one of the restraint elements 4: as a result, the restraint elements 4 define a retention effect and/or function along the axis normal to the upper surface 2*a* of the base element 2.

In a possible embodiment of the invention, the step of defining the plurality of restraint elements 4 is carried out by locally deforming one or more section bars 3, for example (but without limitation thereto), the deformation of the section bars 3 is carried out by drawing, or indenting, or bending, or calendering said section bars 3.

Figure 5:
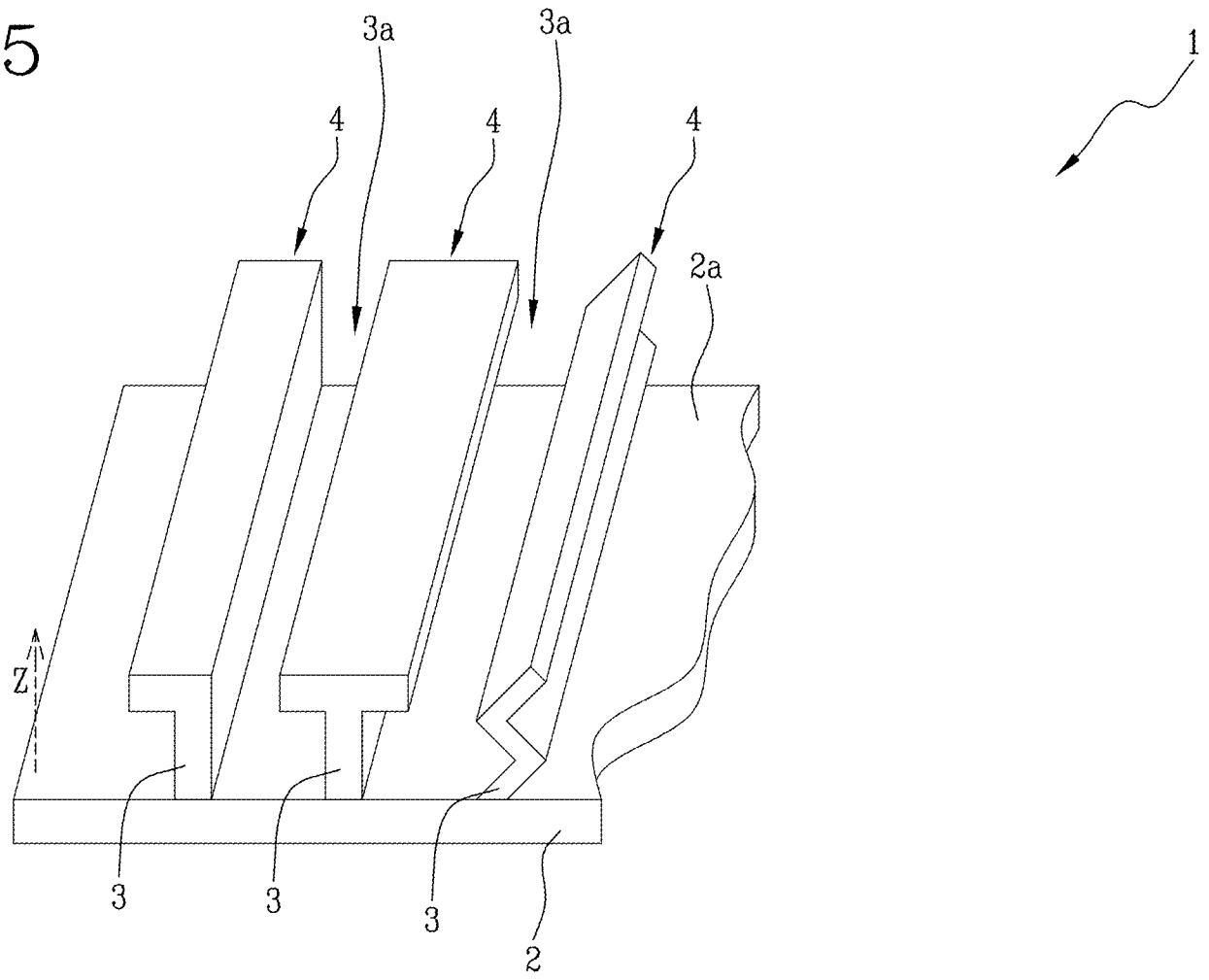
FIG. 5 is a schematic representation of a further embodiment of the semi-finished object.

Alternatively, the step of defining the plurality of restraint elements 4 is carried out by shaping the section bars 3 to create an undercut. For example, FIG. 5 shows possible shapes of the section bars 3 in order to create restraint elements 4 below which the filling material 6 can penetrate and then be retained. For example, the section bars 3 can be shaped so as to define a T- or inverted L-restraint element. Alternatively, a section bar 3 may be shaped so that it has an "accordion" shape or characterized by a surface (along the vertical axis "Z") which is embossed or exhibits protuberances, the size of which is less than half the distance between one section bar and the other and greater than 0.5 mm, i.e., the extent of the polymer shrinkage during cooling; these protuberances will act as restraint elements.

The restraint elements 4 can be defined on a top portion of the section bars 3 (i.e., a maximum distal portion of the section bars 3 with respect to the base element 2) or can be defined in a middle portion of the section bars 3 (i.e., a portion interposed between the surface 2*a* and the maximum distal portion) or, as described in the above paragraph, along the vertical surface.

In other words, the restraint elements 4 are made by riveting the section bars 3 so that portions are created to intercept the vertical axis "Z" normal to the upper surface 2*a*.

The aforementioned step of defining a plurality of restraint elements 4 can be carried out by defining one or more holes in at least one section bar 3: in other words, the method involves creating through holes in one or more section bars 3 so that the "channel" thus created defines a restraint along the axis normal to the upper surface 2*a*.

In the presence of these holes, the filling material creeps into the through holes, preventing the rest of the material deposited within the respective containment cells 3*a* from moving along the vertical axis "Z".

According to a further possible embodiment of this method, the step of defining the plurality of restraint elements 4 is carried out by arranging one or more section bars 3 at a predetermined tilt angle "A" with respect to the surface 2*a;* in other words, the tilted section bars 3 define the restraint element 4 by intercepting the vertical axis "Z".

In accordance with one aspect of the invention, the section bars 3 may be tilted (with respect to the normal direction exiting the surface 2*a*) so as to facilitate the insertion of the filling material: in this geometrical/topological possibility, the tilted section bars 3 can also be alternated with non-tilted section bars 3 (and thus parallel to the vertical axis "Z") along a direction of extension of the base element 2.

In quantitative terms, the tilted section bars 3 can be tilted with respect to the base element 2 (i.e., with respect to the vertical axis "Z") at an angle comprised between 45° and 90°.

Figure 4:
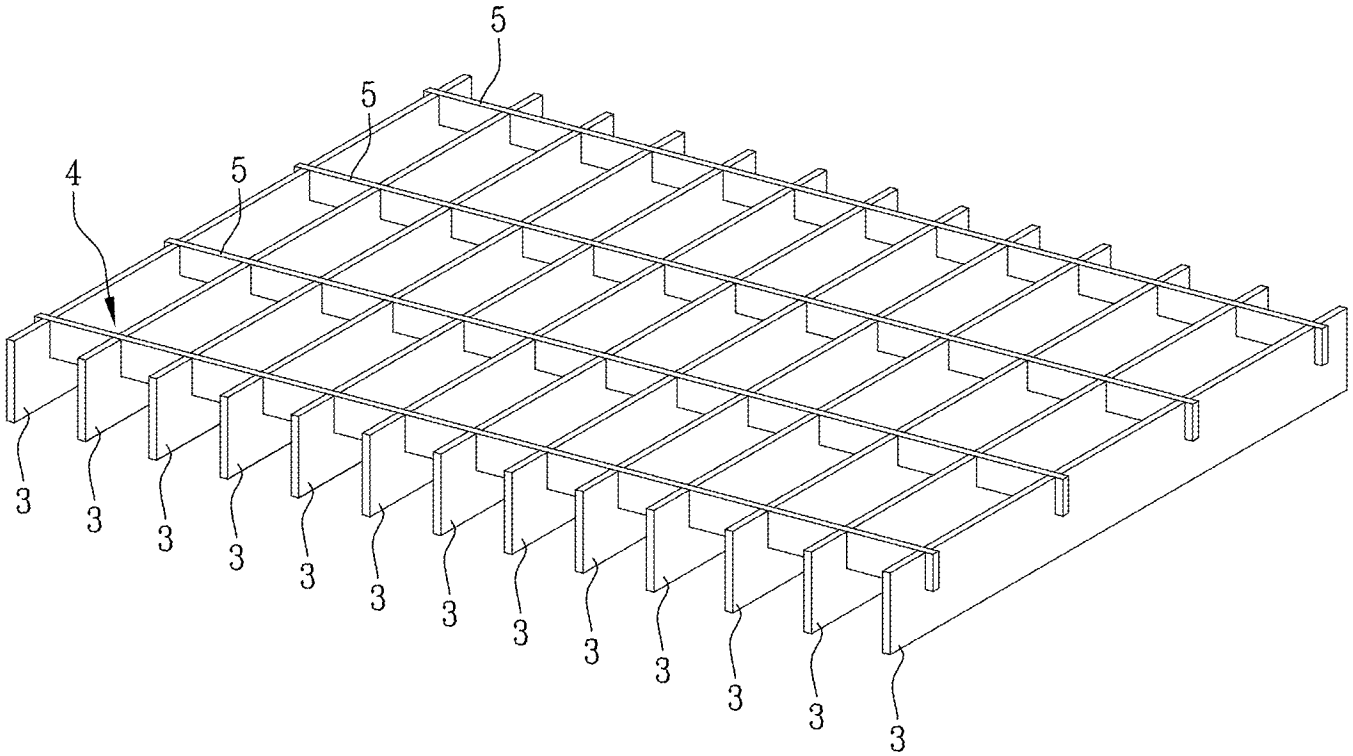
FIG. 4 is a schematic representation of a component of a further embodiment of the semi-finished object.

As regards the step of defining the plurality of restraint elements 4, this can be carried out by crossing the section bars 3 with a plurality of inserts 5 fastened in a top or middle portion of each section bar 3, as shown by way of example in FIG. 4: in turn, the inserts 5 can be fastened prior to the step of welding the section bars 3 to the base element 2 or subsequently thereto (the accompanying figures show by way of example that the inserts 5 give the section bars 3 a substantially T-shape where each insert 5 intercepts the vertical axis "Z").

Each containment cell 3*a* includes at least one restraint element 4, and in this regard the step of defining the restraint elements 4 can be a combination of the steps described above (in other words, a single object 1 can exhibit restraint elements 4 made by deformation, tilting or drilling of the section bars 3 and/or by the addition of inserts 5).

The method further comprises applying, preferably by an additive manufacturing or overmoulding process, a filling material 6 onto the base element 2 bearing the restraint elements 4: this filling material 6 is applied at least in the engagement portion cooperatively defined between the surface 2*a* of the base element 2 and at least one of the restraint elements 4.

In other words, the filling material 6 (which may be, for example, a polymeric material), deposits within the containment cells 3*a* and creeps into the restraint elements 4 (when they are in the form of through holes) or underneath the restraint elements 4 (when they are defined by deformation or tilting of the section bars 3 or by addition of inserts 5): in this way, the filling material 6 "clings" to the restraint elements 4 and its mobility along the vertical axis "Z" is prevented by the restraint elements 4.

Advantageously, the method provides a step of creating undercuts within which the filling material 6 penetrates and sticks, thereby preventing it from sliding along the vertical axis "Z"; in this way, the object 1 made by the present method ensures that the material deposited on the interface structure is not removed therefrom.

Figure 2B:
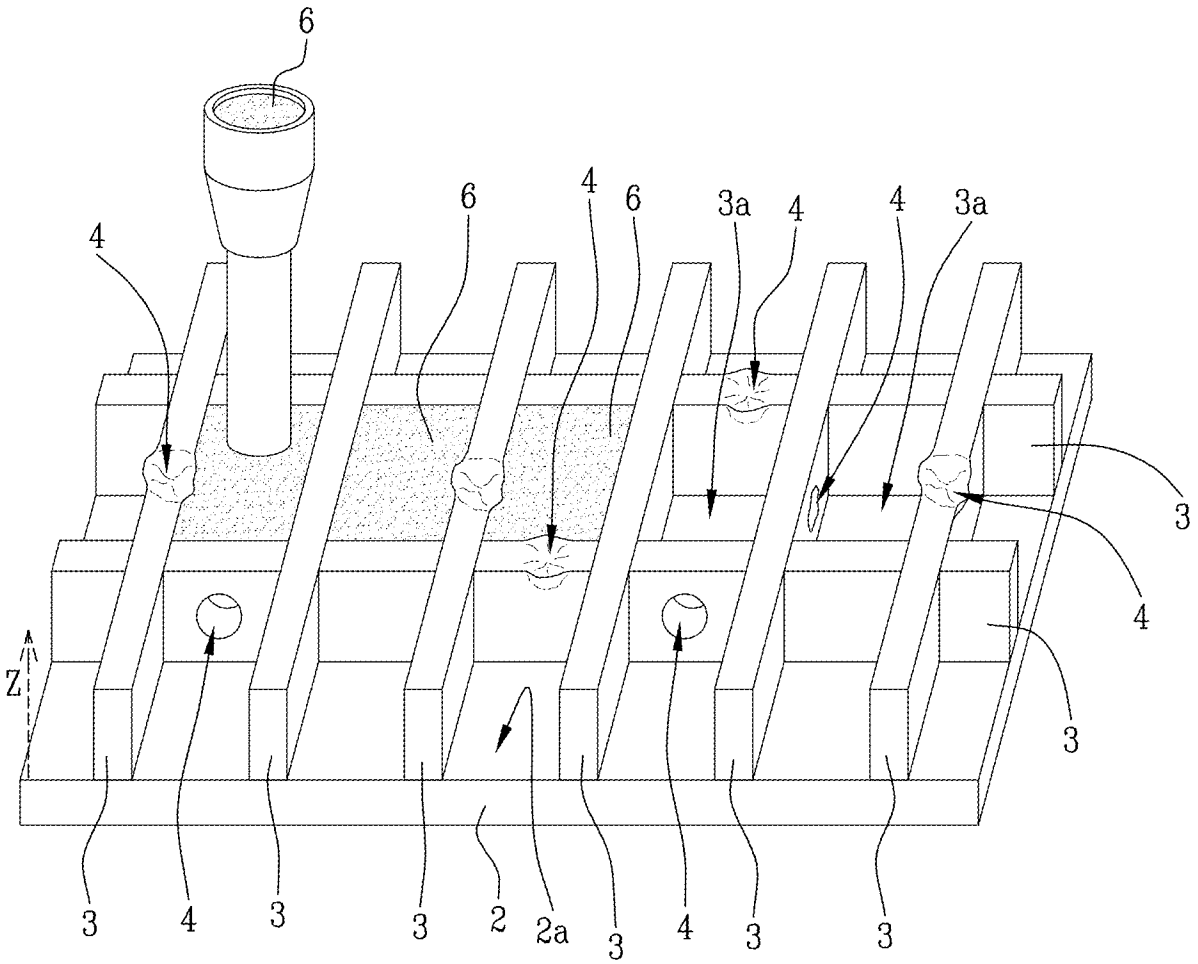
FIG. 2B is a schematic representation of a step of the method object of the present invention with reference to the embodiment of the object in FIG. 2A.
Figure 3:
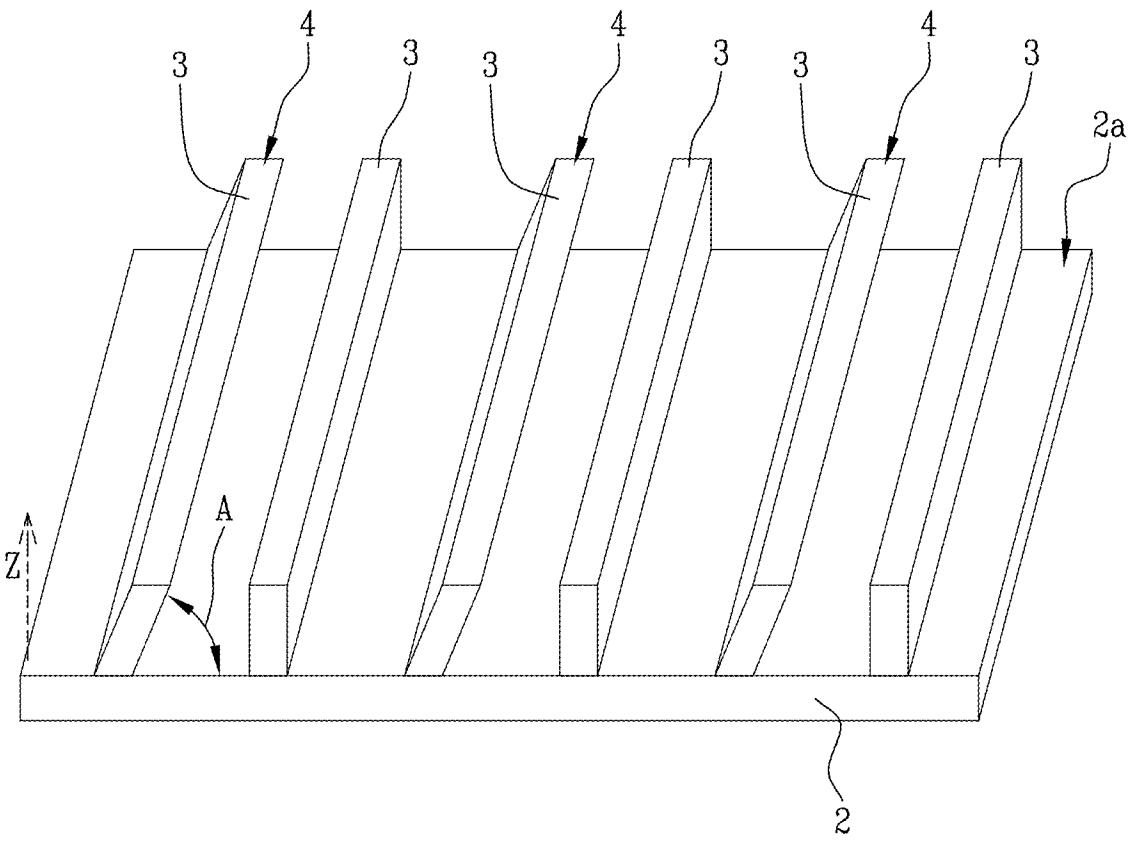
FIG. 3 is a schematic representation of a further embodiment of the semi-finished object.

In particular, as can be seen, for example, in FIG. 2B, the filling material 6 is retained by the respective restraint elements 4 which prevent it from detaching from the base element 2.

The present method further comprises a milling step for the production of a standard object 1, or, through this method, a support base for the filling material 6 can be created, which can be defined by a grid welded to a smooth base, a series of welded metal strips which are skewed or riveted to a "base plate" (or more generally, the base element 2), a series of metal strips fitted in a groove cut into the base support and then optionally welded, or a preformed foam welded or made on top of the base element or plate 2.

In alternative embodiments, the method includes the possibility of using a metal powder sintered against the base metal surface (or also, the possibility of using a weld bead made without an assist gas): this creates a superstructure resting on the base surface 2*a* that has a "bubble" or more generally an "open-cell" topology, inside which the polymer can slip.

Advantageously, the support made by using the present method has a peculiar morphology, and at the same time performs a peculiar structural function which gives the object 1, as a whole, particularly effective properties in terms of the ability of the polymeric material to interpenetrate (and therefore to establish a significant overall restraint) in the context of this methodology: in accordance with the invention, this interpenetration ability is far greater than that achieved with the known methodologies referred to above, in which the polymeric material—for the various reasons, again, mentioned above—cannot reach all the prearranged internal spaces . . . or reaches and fills them however in an incomplete way, or does not go "deeply" into the honeycomb structure.

Advantageously, the method disclosed and described herein allows a wide range of products to be produced in a particularly effective way: the present invention therefore also consists of an object 1 made by the method described above and/or claimed below.

The invention claimed is:

1. A method for the production of an object comprising the steps of:

providing a base element, providing a plurality of section bars; and fastening said section bars to an upper surface of said base element;

defining a plurality of restraint elements, which are at least active along a vertical axis perpendicular to said base element, by one or more of said section bars; and applying a filling material onto said base element at least in one engagement portion cooperatively defined between said surface and at least one of said restraint elements, said step of applying a filling material being performed by an additive manufacturing process;

wherein said step of defining the plurality of restraint elements is carried out by locally deforming one or more section bars; and wherein said step of defining a plurality of restraint elements is carried out by defining one or more holes in at least one section bar.

2. The method according to claim 1, wherein said local deformation of one or more section bars is carried out by drawing, or indenting, or bending, or calendering, or shaping.

3. The method according to claim 1, wherein said step of defining the plurality of restraint elements is carried out by arranging one or more section bars at a predetermined tilt angle with respect to said surface.

4. The method according to claim 3, wherein said tilt angle is comprised between 45° and 90°.

5. The method according to claim 1, wherein said step of defining the plurality of restraint elements is carried out by crossing said section bars with a plurality of inserts, which are fastened or can be fastened in a top or middle portion of each section bar.

6. The method according to claim 1, wherein the step of providing the section bars is carried out in such a way that said section bars define a grid element in which said section bars are intertwined.

7. The method according to claim 6, wherein said step of providing the section bars defines a plurality of containment cells and wherein said step of defining the plurality of restraint elements is carried out in such a way that each containment cell includes at least one restraint element.

8. The method according to claim 1, wherein said step of fastening the section bars to the base element is carried out by welding or sintering the section bars to the base element.

9. The method according to claim 1, further comprising cutting out the base element so as to create a plurality of grooves in said base element, said fastening step being carried out by fitting said section bars into respective grooves.

10. The method according to claim 1, further comprising a milling step for the making of an object.

* * * * *